US006515571B2

(12) United States Patent
Takeda

(10) Patent No.: US 6,515,571 B2
(45) Date of Patent: Feb. 4, 2003

(54) THERMAL PROTECTOR

(75) Inventor: Hideaki Takeda, Misato (JP)

(73) Assignee: Uchiya Thermostat Co., Ltd., Saitama-ken (JP)

( * ) Notice: Subject to any disclaimer, the term of this patent is extended or adjusted under 35 U.S.C. 154(b) by 95 days.

(21) Appl. No.: 09/828,820

(22) Filed: Apr. 10, 2001

(65) Prior Publication Data

US 2001/0050609 A1 Dec. 13, 2001

(30) Foreign Application Priority Data

Apr. 17, 2000 (JP) ..... 2000-115282

(51) Int. Cl.[7] ..... H01H 37/52; H01H 37/18

(52) U.S. Cl. ..... 337/375; 337/333; 337/342; 337/343; 337/380

(58) Field of Search ..... 337/333, 334, 337/342, 343, 380, 373, 375

(56) References Cited

U.S. PATENT DOCUMENTS

| | | | | | |
|---|---|---|---|---|---|
| 3,796,982 | A | * | 3/1974 | Auracher | 337/343 |
| 3,936,788 | A | * | 2/1976 | Uchiya | 337/343 |
| 4,032,180 | A | * | 6/1977 | Pohl | 200/61.64 |
| 4,166,995 | A | * | 9/1979 | Pecker et al. | 337/131 |
| 4,220,939 | A | * | 9/1980 | Grable | 29/622 |
| 4,445,107 | A | * | 4/1984 | Hollweck | 337/343 |
| 4,620,175 | A | * | 10/1986 | Karr et al. | 337/343 |
| 4,698,612 | A | * | 10/1987 | Koehler | 337/313 |
| 5,233,325 | A | * | 8/1993 | Takeda | 337/102 |
| 5,621,376 | A | * | 4/1997 | Takeda | 29/622 |
| 5,659,285 | A | * | 8/1997 | Takeda | 337/333 |
| 5,757,262 | A | * | 5/1998 | Takeda | 337/333 |
| 5,847,637 | A | * | 12/1998 | Takeda et al. | 337/3 |
| 5,870,013 | A | * | 2/1999 | Van Der Grijn et al. | 337/111 |
| 6,211,582 | B1 | * | 4/2001 | Reimold et al. | 307/117 |
| 6,281,780 | B1 | * | 8/2001 | Sugiyama et al. | 174/117 FF |
| 6,396,381 | B1 | * | 5/2002 | Takeda | 337/342 |

FOREIGN PATENT DOCUMENTS

| | | | | |
|---|---|---|---|---|
| EP | 58372 A1 | * | 8/1982 | H01H/37/54 |
| EP | 507425 A1 | * | 10/1992 | H01H/61/02 |
| GB | 2083709 A | * | 3/1982 | H01H/37/54 |
| JP | 06020571 A | * | 1/1994 | H01H/37/54 |
| JP | 06084440 A | * | 3/1994 | H01H/37/54 |
| JP | 06119859 A | * | 4/1994 | H01H/37/54 |

* cited by examiner

*Primary Examiner*—Anatoly Vortman
(74) *Attorney, Agent, or Firm*—Birch, Stewart, Kolasch & Birch, LLP

(57) ABSTRACT

A thermal protector is configured so that a raised portion 23 and a lowered portion 27 with the attachment face of a movable contact 21 being the reference are provided at the rear of and close to the movable contact 21 on a movable plate 20, and a tongue 31 projectingly provided in a front end portion of a bimetal element 30 is fitted in a gap 24 formed by the raised portion 23 and lowered portion 27. Therefore, a thin shape can be realized without impaired stability of operation.

18 Claims, 15 Drawing Sheets

THERMAL PROTECTOR

FIELD OF THE INVENTION AND RELATED ART STATEMENT

The present invention relates to a thermal protector suitably applied to a small battery pack used for a cellular phone and the like.

FIG. 16 shows one example of a conventional thermal protector incorporated in a small battery pack or the like. This thermal protector is configured so that a bimetal element 2 and a movable plate 3 are disposed in succession over a fixed conductive plate 1, the fixed conductive plate 1 being connected with a terminal 4, and the movable plate 3 being connected with a terminal 5.

In this thermal protector, when the ambient temperature of the bimetal element 2 rises to a predetermined temperature, the bimetal element 2 performs reversing operation. Thereby, a front end portion of the bimetal 2 pushes up the movable plate 3 via a protrusion 3*a* provided on the lower face of the movable plate 3. As a result, a movable contact 3*b* provided on the movable plate 3 is separated from a fixed contact 1*a* provided on the fixed conductive plate 1, by which the terminals 4 and 5 are made non-conductive electrically.

Therefore, the interposition of this thermal protector in a current-carrying path of the battery pack protects the battery from overcurrent or the like.

In the above-described thermal protector, the bimetal element 2 always applies a push-up force to the movable plate 3 because of the draw shape of the bimetal element 2, so that it is difficult to secure a pressing force of the movable contact 3*b* against the fixed contact 1*a* by means of a spring force of the movable plate 3.

In order to avoid this problem, it is necessary only that the size of the bimetal element 2 be restricted. However, if the size of the bimetal element 2 is restricted, a reversely driving force of the bimetal element 2 becomes insufficient, so that there is a fear that normal switching operation cannot be performed.

Specifically, for example, a state is considered in which after the contact 3*b* is raised by the reversing operation of the bimetal element 2 caused by a rise in ambient temperature, the ambient temperature lowers. In this case, a state sometimes occurs in which a force for maintaining the reversed state of the bimetal element 2 becomes lower than the spring force of the movable plate 3, by which the contact 3*b* is closed.

Also, in the thermal protector having a construction as described above, the movable plate 3 is often used by being bent into a chevron shape. In this case, since a case 6 has no allowance in the thickness direction, the movable plate 3 is incorporated in such a manner that the vertex of the movable plate 3 is pushed in the inside surface of the case 6. As a result, an actual span in which the bimetal element 2 raises the movable plate 3 is smaller than a span when the movable plate 3 is in a free state. That is to say, the upper limit of the above-described actual span is the height of the vertex of the movable plate 3 pushed in by the case 6.

As described above, if the sway span of the movable plate 3 is restricted, a stress applied to the bimetal element 2 increases to several times, so that a state occurs in which normal switching operation cannot be performed.

On the other hand, in the above-described conventional thermal protector, the protrusion 3*a,* which serves as a point of application for reversing operation, is provided on the lower face of the movable plate 3, which results in an increase in the thickness of the thermal protector.

In effect, despite the fact that the thermal protector used for a battery pack is required to be thin, it is difficult to decrease the total thickness of the fixed contact 1*a* and the movable contact 3*b,* and to secure a space for reversing operation of the bimetal element 2 in the combination with the movable plate 3 to perform switching operation without trouble by using a thin shape.

A thermal protector in which the bimetal element is disposed over the movable plate has been used practically. In the conventional thermal protector of this type, configuration is such that an end portion of the bimetal element is fitted lockingly to a locking claw projecting from the top face of the movable plate, which presents a problem in that the thickness of the whole of a switching mechanism section increases.

Also, a thermal protector using no movable plate, that is, a thermal protector that is configured so that the movable contact is installed to the bimetal element, and a load current is carried in that bimetal element has been used practically. In this thermal protector, it is difficult to install a thin contact to the bimetal element. Also, in the case where the contact is installed to the bimetal element, it is difficult to obtain stable quality because the characteristics of the bimetal element vary greatly.

OBJECT AND SUMMARY OF THE INVENTION

The present invention has been made in view of the above situation, and accordingly an object thereof is to provide a thermal protector in which a thin shape can be realized without impaired stability of operation.

To achieve the above object, the present invention provides a thermal protector having a switching mechanism section comprising a fixed conductive plate which has a first terminal for connection to an outside circuit and is provided with a fixed contact on the upper face thereof; an elastic movable plate located over the fixed conductive plate, which has a second terminal for connection to an outside circuit at the rear end thereof and is provided with a movable contact opposed to the fixed contact on the lower face of a front end portion thereof; and a bimetal element located over the movable plate, which operates the movable plate by a warping force when a preset temperature is exceeded, whereby the movable contact is separated from the fixed contact, wherein a raised portion and a lowered portion with the attachment face of the movable contact being the reference are provided at the rear of and close to the movable contact on the movable plate, and a front end portion of the bimetal element is fitted in a gap formed by the raised portion and lowered portion.

In a preferred embodiment of the present invention, the raised portion and lowered portion are formed so that these portions have a substantially cranked shape in cross section, and the lower face of the raised portion is located at a position raised through a distance corresponding to the thickness of the movable plate from the upper face of the movable plate, so that the upper face of the front end portion of the bimetal element fitted in the gap substantially coincides with the contact attachment face of the movable plate.

In a preferred embodiment of the present invention, a protective cover is provided over the switching mechanism section, and a convex portion for pressing the upper face of a central portion of the bimetal element is formed on the lower face of the protective cover.

It is preferable that the projection height of the convex portion be set so that after an increase in curvature of the bimetal is started by a rise in ambient temperature, a pressing force is released before the ambient temperature rises to the reversing operation temperature of the bimetal element.

In a preferred embodiment of the present invention, a gap formed by the raised portion and lowered portion is provided in a central portion in the width direction of the movable plate.

In a preferred embodiment of the present invention, a gap formed by the raised portion and lowered portion is provided at both sides in the width direction of the movable plate.

In a preferred embodiment of the present invention, the fixed conductive plate is fixed integrally to a resin-made support surrounding the side periphery of the switching mechanism section, and the protective cover is formed of a metallic sheet and is disposed on the upper face of the support.

In a preferred embodiment of the present invention, protrusions are projectingly provided on the upper face of the support, and the protective cover is fixed to the support by fitting holes formed around the cover on the protrusions and then by crushing top portions of the protrusions.

In a preferred embodiment of the present invention, a resin-made frame is integrally formed around the protective cover, and the cover is fixed to the support by welding the frame onto the upper face of the support by ultrasonic welding.

It is preferable that the outside surface of the fixed conductive plate and/or the protective cover provided on the support be covered with an electrical insulating film with a small thickness.

Also, it is preferable that the electrical insulating film have a thickness not greater than 50 $\mu$m.

The present invention provides a thermal protector having a switching mechanism section comprising a fixed conductive plate which has a first terminal for connection to an outside circuit and is provided with a fixed contact on the upper face thereof; an elastic movable plate located over the fixed conductive plate, which has a second terminal for connection to an outside circuit at the rear end thereof and is provided with a movable contact opposed to the fixed contact on the lower face of a front end portion thereof; and a bimetal element located over the movable plate, which operates the movable plate by a warping force when a preset temperature is exceeded, whereby the movable contact is separated from the fixed contact, wherein a raised portion directed to the rear side from the rear end of a front end portion of the movable plate including the movable contact is formed by bending a portion close to the rear end of the movable contact into a step form so that the front end portion is higher than a portion at the rear of the front end portion, and a front end portion of the bimetal element is fitted in a gap formed by the raised portion.

In a preferred embodiment of the present invention, the raised portion is formed so that the lower face thereof is located at a position raised through a distance corresponding to the thickness of the movable plate from the upper face of the movable plate, so that the upper face of the front end portion of the bimetal element fitted in the gap substantially coincides with the contact attachment face of the movable plate.

In a preferred embodiment of the present invention, a protective cover is provided over the switching mechanism section, and a convex portion for pressing the upper face of a central portion of the bimetal element is formed on the lower face of the protective cover.

In a preferred embodiment of the present invention, the projection height of the convex portion is set so that after an increase in curvature of the bimetal is started by a rise in ambient temperature, a pressing force is released before the ambient temperature rises to the reversing operation temperature of the bimetal element.

In a preferred embodiment of the present invention, a gap formed by the raised portion is provided in a central portion in the width direction of the movable plate.

In a preferred embodiment of the present invention, a gap formed by the raised portion is provided at both sides in the width direction of the movable plate.

The present invention provides a thermal protector having a switching mechanism section comprising a fixed conductive plate which has a first terminal for connection to an outside circuit and is provided with a fixed contact on the upper face thereof; an elastic movable plate located over the fixed conductive plate, which has a second terminal for connection to an outside circuit at the rear end thereof and is provided with a movable contact opposed to the fixed contact on the lower face of a front end portion thereof; and a bimetal element located over the movable plate, which operates the movable plate by a warping force when a preset temperature is exceeded, whereby the movable contact is separated from the fixed contact, wherein a portion close to the rear end of the movable contact is bent into a step form so that a front end portion of the movable plate including the movable contact is higher than a portion at the rear of the front end portion, and a hole is opened in a rising face formed by the bending operation so that a front end portion of the bimetal element is fitted in the hole.

The present invention having the construction as described above achieves the following effects.

1) A thin shape can be realized. In particular, the thickness can be made not greater than 1 mm, so that the thermal protector in accordance with the present invention can be suitably used for a battery pack for small-sized equipment such as a cellular phone.
2) In spite of the thin shape, both of OFF and ON switching operations can be performed normally by using the bimetal element. Specifically, a switching operation, in which the reversing operation of the bimetal element and the opening/closing operation of the contact are accomplished synchronously, can be performed.
3) Since the movable contact slides due to a wiping operation, the contacting properties of contacts are stabilized, resulting in improved reliability.
4) In spite of the thin shape, the switching operation is performed normally while a high contact pressure of the contacts is secured. Therefore, performance equivalent to that of a protector having a thickness two times and more the thickness of the protector in accordance with the present invention can be ensured.

DETAILED DESCRIPTION OF PREFERRED EMBODIMENTS

Figure 1:
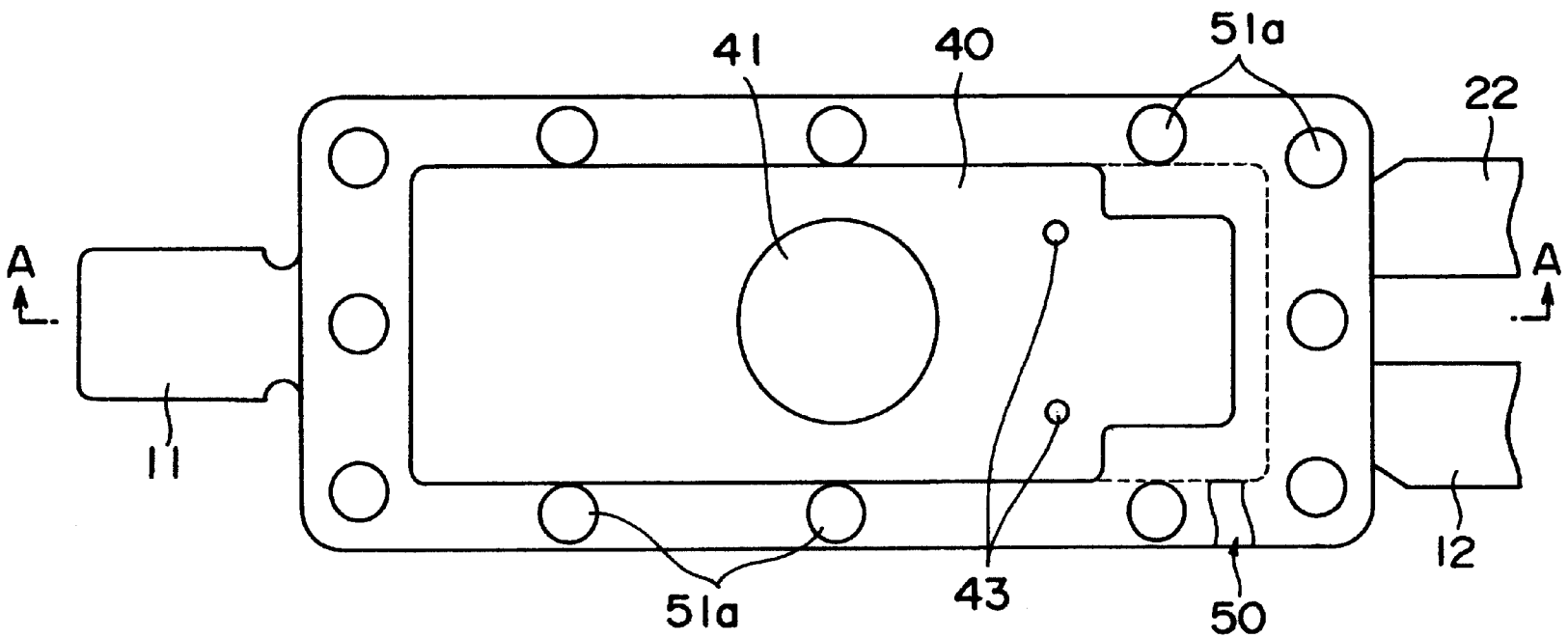
FIG. 1 is a plan view showing an embodiment of a thermal protector in accordance with the present invention.
Figure 2:
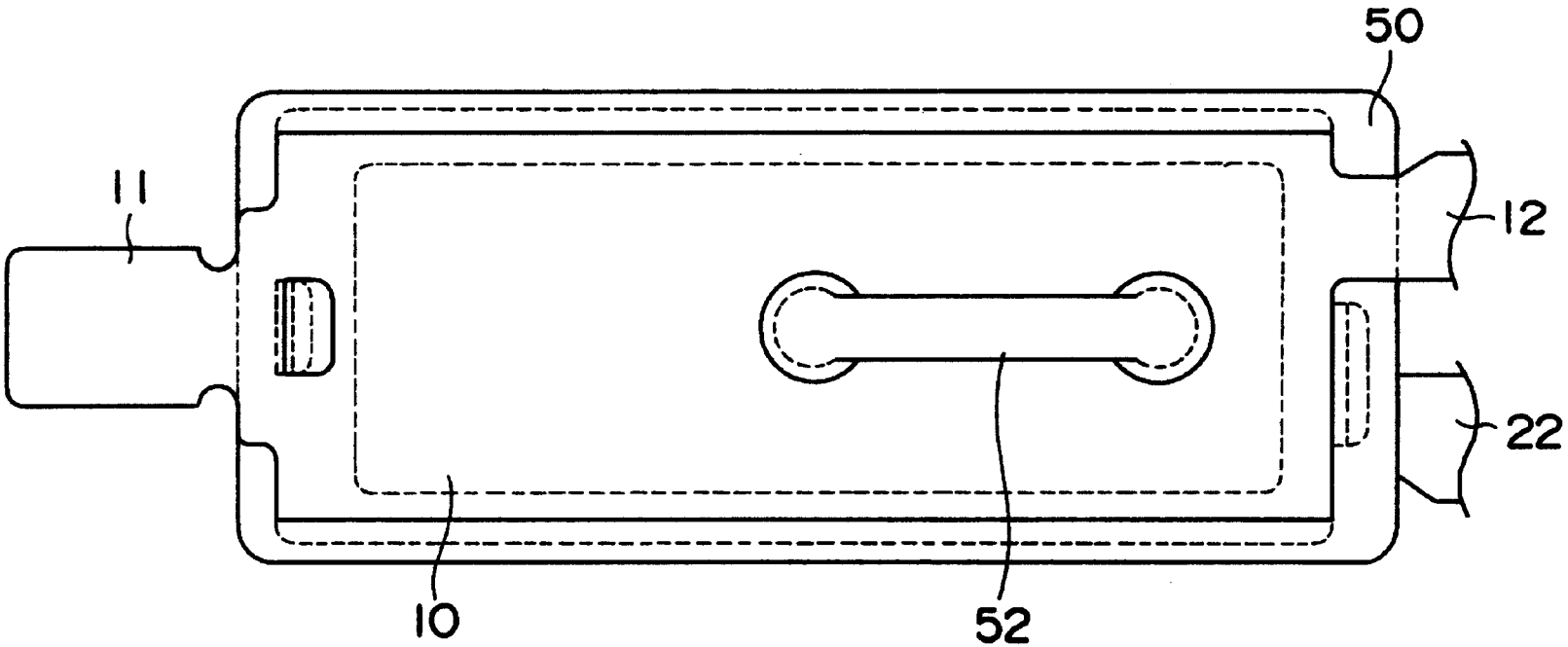
FIG. 2 is a bottom view of the thermal protector shown in FIG. 1.
Figure 3:
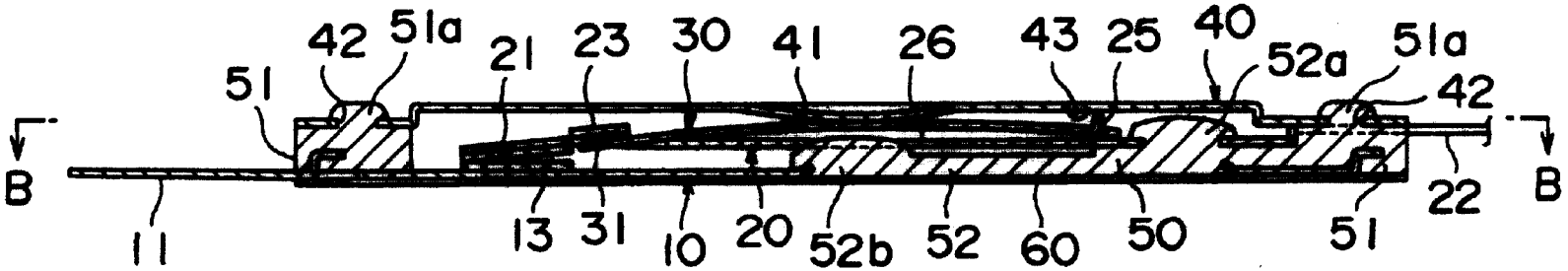
FIG. 3 is a sectional view taken along the line A—A of FIG. 1.
Figure 4:
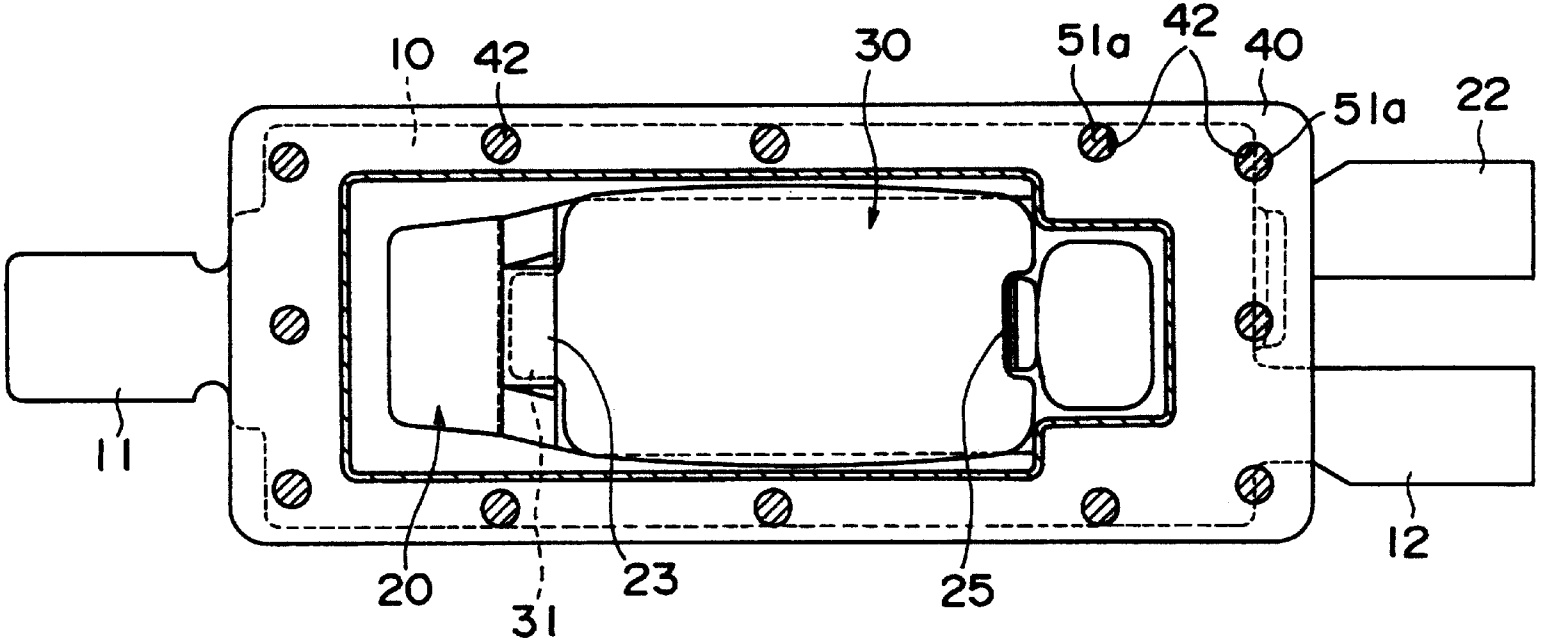
FIG. 4 is a sectional view taken along the line B—B of FIG. 3.

FIGS. 1 and 2 are a plan view and a bottom view, respectively, of a thermal protector in accordance with the present invention. Also, FIG. 3 is a sectional view taken along the line A—A of FIG. 1, and FIG. 4 is a sectional view taken along the line B—B of FIG. 3.

In this thermal protector, a fixed conductive plate 10 has first terminals 11 and 12 for connection to an outside circuit at one end and the other end, respectively, and also is provided with a fixed contact 13 on the upper face at a one end portion thereof.

A movable plate 20, which is formed of a metallic sheet having elasticity, is provided with a movable contact 21 opposed to the fixed contact 13 on the lower face at a front end portion thereof, and is formed with a second terminal 22 for connection to an outside circuit at the rear end thereof.

Figure 5:
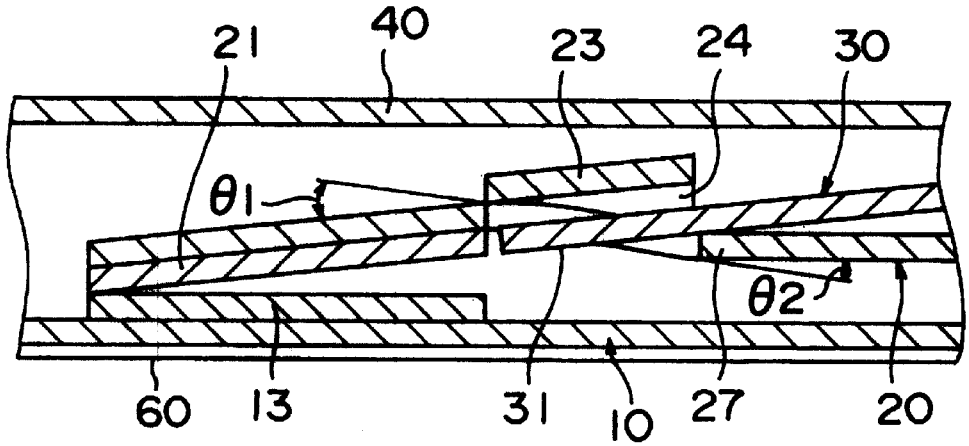
FIG. 5 is a partially enlarged sectional view showing a state in which a bimetal element engages with a movable plate.
Figure 6:
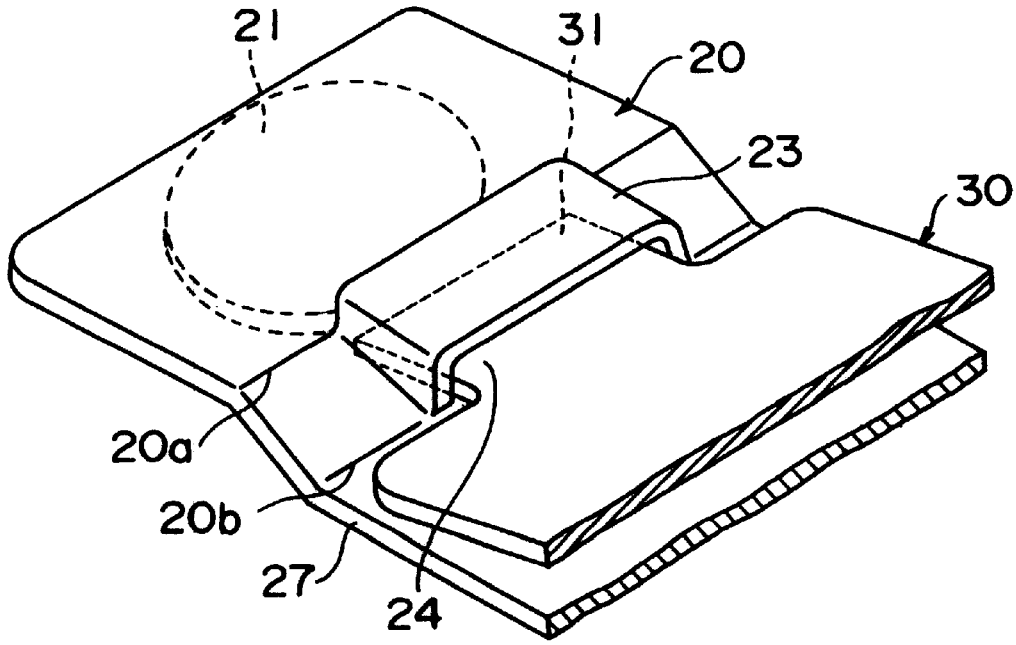
FIG. 6 is a partially enlarged perspective view showing a state in which a bimetal element engages with a movable plate.

As shown enlargedly in FIGS. 5 and 6, for the movable plate 20, a portion at the rear of and close to the movable contact 21 is bent downward through an angle θ1 with a transverse line 20*a* of the movable plate 20 being a bend line, and is bent in the direction opposite to the above description (upward) through an angle θ2 with a transverse line 20*b* positioned at the rear of the transverse line 20*a* being a bend line. Therefore, the side profile of the movable plate 20 positioned in this bent portion has a substantially cranked shape, in other words, has a shape in which a letter Z is deformed by pulling the upper and lower end thereof to the left and right.

On the other hand, the movable plate 20 is formed with a raised portion 23 in a central portion in the width direction between the lines 20*a* and 20*b*. The raised portion 23 is formed by extruding the pertinent portion of the movable plate 20 by a press or the like after forming a cutting line along the line 20*b*. In this example, the raised portion 23 projects upward through a distance corresponding to the thickness of substantially one plate of the movable plate 20 with the attachment face of the contact 21 being the reference.

By the bending and extruding operations performed on the movable plate 20, a lowered portion 27 is substantially formed at a portion at the right of the rear end of the raised portion 23. The raised portion 23 and the lowered portion 27 form an opening (gap) directed toward the rear of the movable plate 20.

Over the movable plate 30 is disposed a bimetal element 30. The bimetal element 30 has a tongue 31 projecting in a central portion at a front end thereof which is inserted in the raised portion 23 through the opening 24. Also, as shown in FIG. 4, the rear end of the bimetal element 30 is engaged with a locking element 25 raisedly formed at the rear end of the movable plate 20.

As shown in FIG. 5, the front end upper face of the tongue 31 of the bimetal element 30 substantially coincide with the attachment face of the contact 21 on the movable plate 20. In effect, the bending angles θ1 and θ2 of the movable plate 20 are set considering the curvature, thickness, and the like of the bimetal element 30 in order to prevent the front end of the tongue 31 from projecting downward greatly from the contact attachment face of the movable plate 20. Also, the rising height of the raised portion 23 is set so that the opening 24 has a height dimension such that the tongue 31 can be engaged with the opening 24 with a play.

Over the bimetal element 30 is disposed a cover 40 formed of a thin metallic sheet (for example, a stainless steel sheet with a thickness of 0.1 mm). As shown in FIG. 3, the cover 40 is provided with a convex portion 41 projecting downward in a central portion thereof, and the convex portion 41 presses a central portion of the bimetal element 30 downward.

A support 50, which is formed of an electrical insulating resin, includes a peripheral wall portion 51 surrounding the side periphery of a switching mechanism section consisting of the movable plate 20 and the bimetal element 30 and an internal support portion 52 extending to the inside from the peripheral wall portion 51.

The fixed conductive plate 10 is fixed integrally to the support 50 by embedding a part thereof (cutout or bent portion) in the resin of the support 50. Also, the movable plate 20 is crimped by fitting a hole formed in a rear end portion thereof on a protrusion 52*a* of the internal support portion 52 and then by crushing a top portion of the protrusion 52*a*. The movable plate 20 is formed with a hole 26 in a central portion thereof, and a convex 52*b* of the internal support portion 52 is positioned in the hole 26.

Also, the cover 40 is crimped by fitting holes 42 formed in the peripheral portion thereof on protrusions 51*a* provided on the upper face of the peripheral wall portion 51 of the support 50 and then by crushing top portions of the protrusions 51*a*.

The thermal protector constructed as described above operates as described below. At ordinary temperatures at which the bimetal element 30 does not perform reversing operation, as shown in FIG. 3, the upper face of the central portion of the bimetal element 30 is pressed by the convex portion 41 of the cover 40. The pressing force of the convex portion 41 is also applied to the movable plate 20 via the bimetal element 30. Therefore, the contact 21 is subjected to the pressing force caused by the convex portion 41 in addition to the pressing force caused by the elasticity of the movable plate 20. As a result, the contact pressure of the contact 21 is substantially increased.

As the ambient temperature approaches the reversing operation temperature of the bimetal element 30, the contraction shape of the bimetal element 30 changes and the curvature thereof increases. The pressing force caused by the convex portion 41 is released due to a change in contraction shape occurring when the ambient temperature increases to a temperature close to the reversing operation of the bimetal element 30.

That is to say, the projection height of the convex portion 41 is set so that the convex portion 41 exerts no force on the upper face of the bimetal element 30 at a stage at which the ambient temperature increases to a temperature just before the reversing operation temperature.

This means that the reversing operation temperature of the bimetal element 30 is not changed by the convex portion 41, in other words, the bimetal element 30 reliably performs reversing operation at a predetermined reversing operation temperature.

Figure 7:
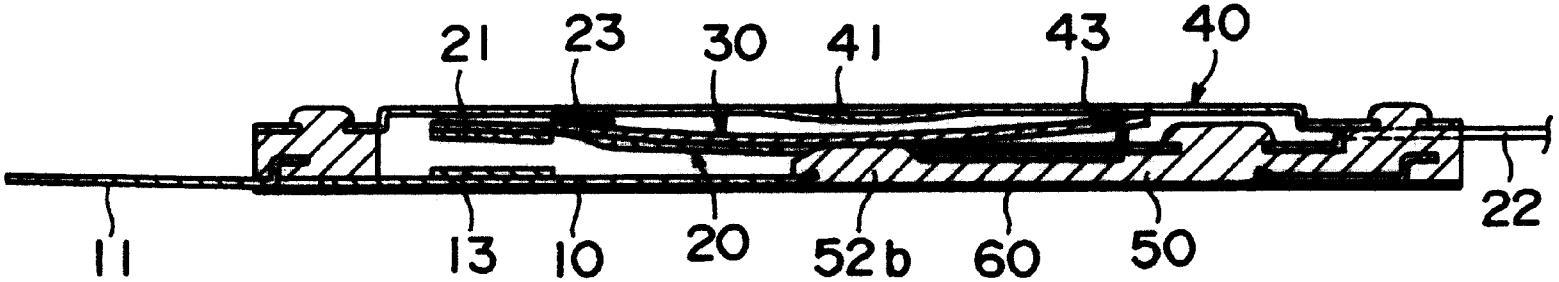
FIG. 7 is a longitudinal sectional view showing a state in which a bimetal element performs reversing operation.

As shown in FIG. 7, when the bimetal element 30 performs reversing operation, the upper face of the front end portion of the bimetal element 30 engages with the raised portion 23 of the movable plate 20, by which the front end portion of the movable plate 20 is raised. Therefore, the movable contact 21 separates from the fixed contact 13, so that electrical connection of the terminal 11 (12) to the terminal 22 is severed.

At this time, the lower face of the central portion of the bimetal element 30 comes into contact with the convex 52*b* of the internal support portion 52, and also the upper face of the rear end portion thereof comes into contact with protrusions 43 projectingly provided on the lower face of the cover 40.

For the thermal protector in accordance with the above-described embodiment, since the front end portion of the bimetal element 30 is fitted in and engaged with the opening 24 formed on the rear side of the movable contact 21 by the raised portion 23 and the lowered portion 27, the shape in the thickness direction can be shortened while a stable switching function is ensured. Moreover, since the cover 40 is formed of a thin stainless steel sheet, and the cover 40 is crimped on the upper face of the support 50, a very thin shape not thicker than 1 mm can resultantly realized.

Also, since the front end portion of the bimetal element 30 engages with the movable plate 20 at a portion on the rear side of the movable contact 21, the movable contact 21 rubs on the fixed contact 13 due to deflection of the movable plate 20 caused when the bimetal element 30 performs reversing and restoring operations (wiping operation). As a result, the contacting properties of the contacts 13 and 21 are improved.

If the cover 40 is formed of a resin, the thickness must be 0.2 mm and greater because of the restriction of the minimum thickness specified in the safety standard. Therefore, it is desirable that the cover 40 be formed of a metallic sheet as in the above-described embodiment.

Also, in order to realize a thinner shape, there can be used a cladding technology for forming the fixed contact 13 by embedding a contact material in the conductive plate 10, a technology for forming the contact 13 by installing a thin metallic film on the conductive plate 10 by means of continuous welding (seam welding), a technology for finishing the individual contacts 13 and 21 into a thin shape by welding or crimping, a technology for forming the contacts 13 and 21 by plating, and other technologies.

In mounting the above-described thermal protector, in a case where the lower face (outside face) of the fixed conductive plate 10 must be insulated electrically, it is necessary only that an insulating film 60 having a small thickness, preferably a thickness not greater than 50 $\mu$m, be put on the lower face of the conductive plate 10. Needless to say, the same insulating film is put on the outside of the cover 40 as well, as necessary. In place of the above-described insulating film, a heat shrinkable tube with a small wall thickness can also be used. In this case, after the thermal protector is covered with the heat shrinkable tube, the tube is shrunk by heating.

Figure 8:
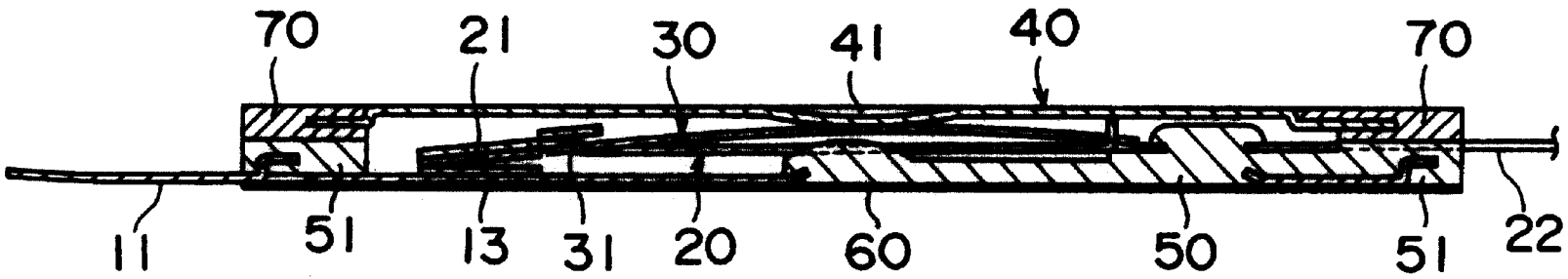
FIG. 8 is a longitudinal sectional view showing a second embodiment of a thermal protector in accordance with the present invention.

FIG. 8 shows a thermal protector in accordance with a second invention of the present invention. This thermal protector has a construction in which a frame 70 is integrally fixed around the cover 40, the frame 70 being welded to the upper face of the peripheral wall portion 51 of the support 50 by using a welding method using ultrasonic waves or the like, and bases of the terminals 11, 12 and 22 are sealed by an adhesive. According to this thermal protector, the sealing ability can be improved.

In this thermal protector, the height of the peripheral wall portion 51 is formed low by the thickness of the frame 70.

Figure 9:
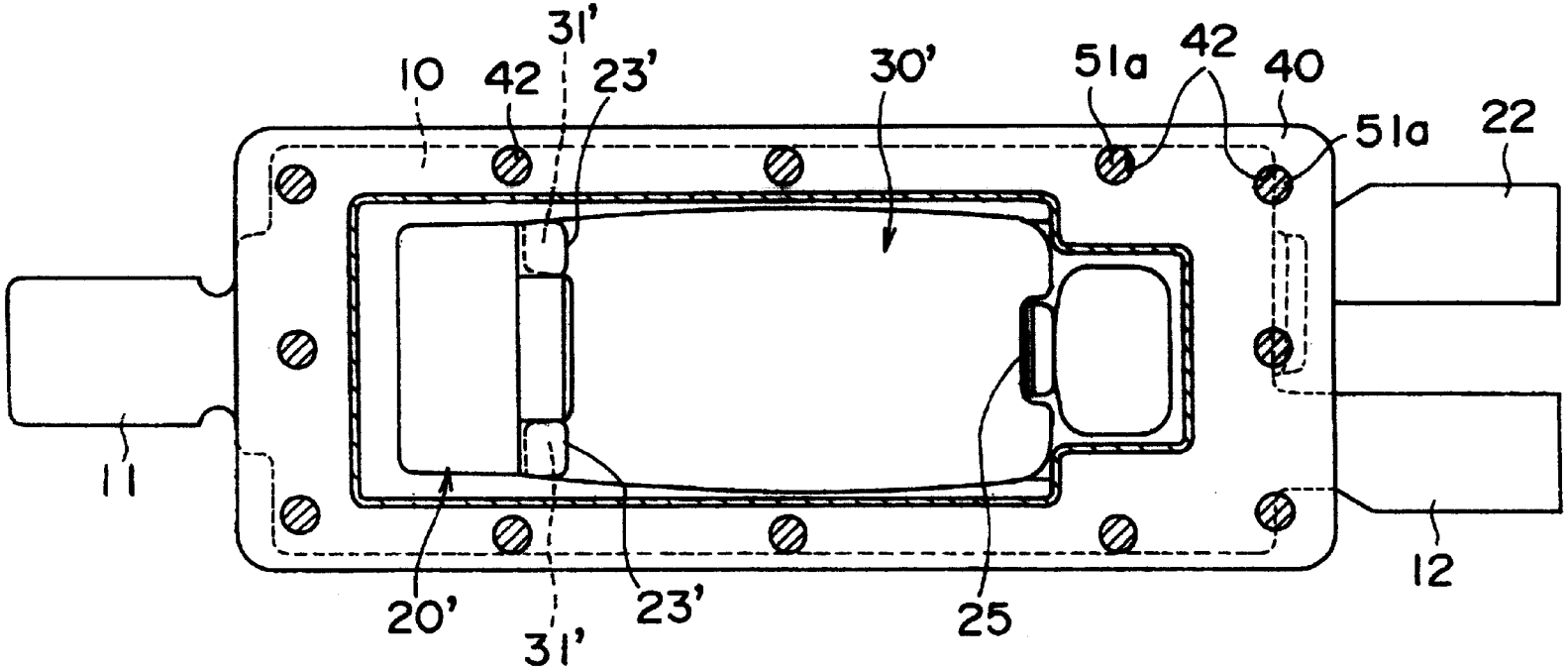
FIG. 9 is a plan view showing a third embodiment of a thermal protector in accordance with the present invention.

FIG. 9 shows a thermal protector in accordance with a third embodiment of the present invention. As enlargedly showing an essential portion in FIG. 10, in this thermal protector, a raised portion 23' and a lowered portion 27' corresponding to the raised portion 23 and the lowered portion 27 shown in FIG. 6, respectively, are formed at both sides in the width direction in a front end portion of a movable plate 20', and also a tongue 31' corresponding to the tongue 31 is formed at both sides in the width direction at the front end of a bimetal element 30', by which the tongue 31' is fitted in a gap 24' formed by the raised portion 23' and the lowered portion 27'.

According to this embodiment as well, as in the above-described first and second embodiments, a thin shape can be realized while a stable switching function is ensured.

Figure 11:
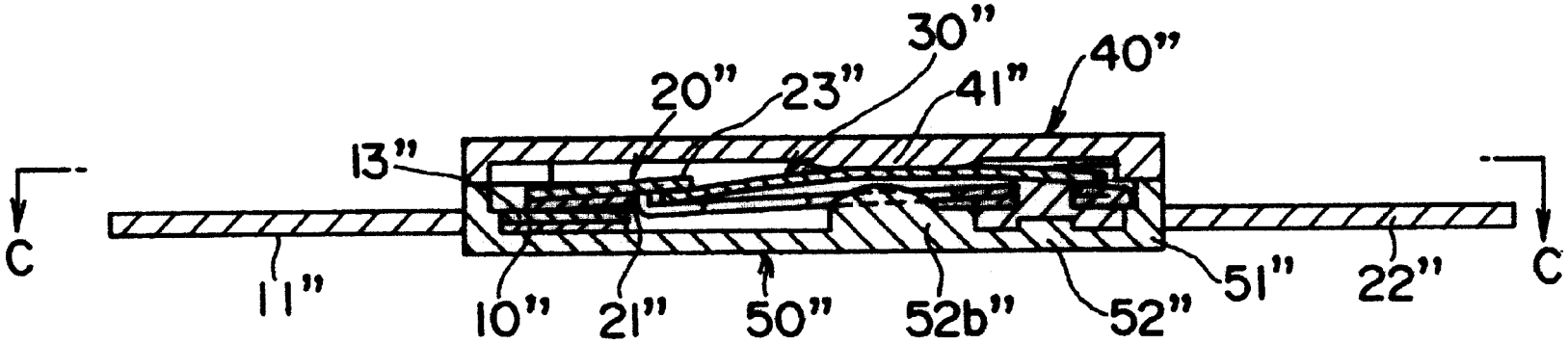
FIG. 11 is a longitudinal sectional view showing a fourth embodiment of a thermal protector in accordance with the present invention.
Figure 12:
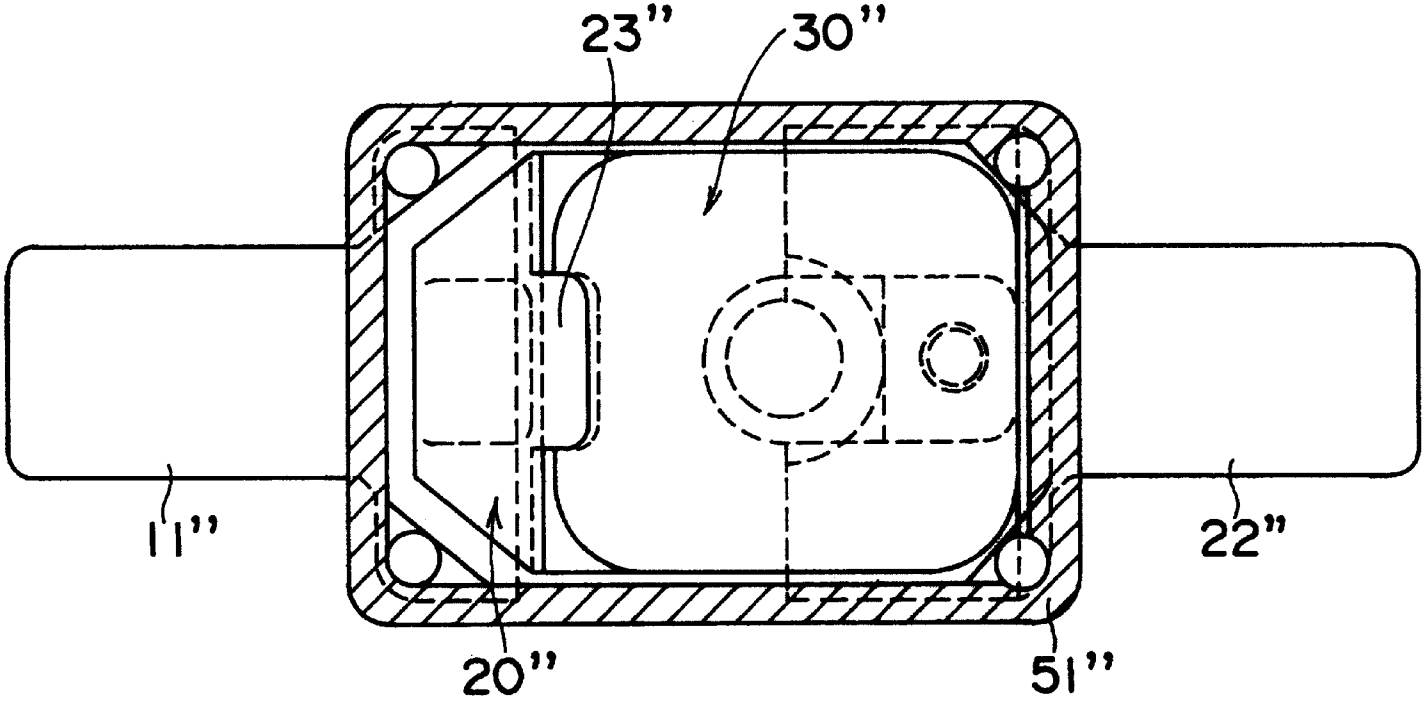
FIG. 12 is a sectional view taken along the line C—C of FIG. 11.

FIG. 11 is a longitudinal sectional view of a thermal protector in accordance with a fourth embodiment of the present invention, and FIG. 12 is a sectional view taken along the line C—C of FIG. 11. In these figures, elements having configuration and operation corresponding to those of the elements shown in FIG. 3 are denoted by a reference numeral with a double quotation mark added to the reference numeral of the element shown in FIG. 3. Since the elements corresponding to the elements shown in FIG. 3 perform the corresponding operation, the explanation of these elements is omitted.

Figure 13:
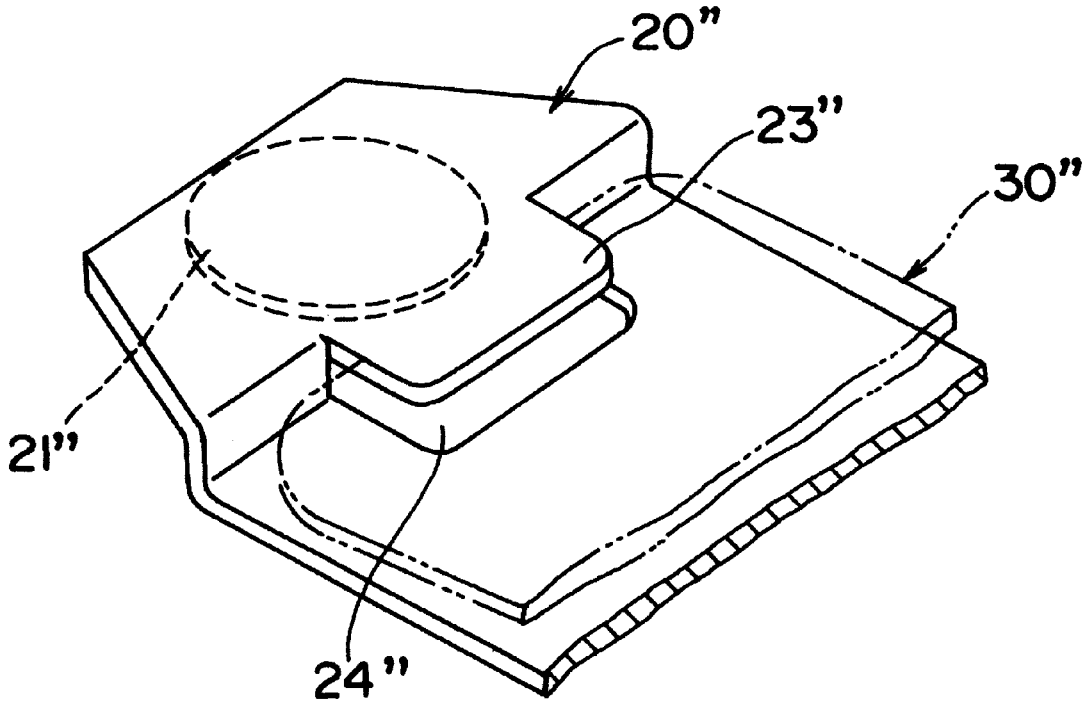
FIG. 13 is a partially enlarged perspective view showing an engagement state of a bimetal element in the thermal protector shown in FIG. 11.
Figure 14:
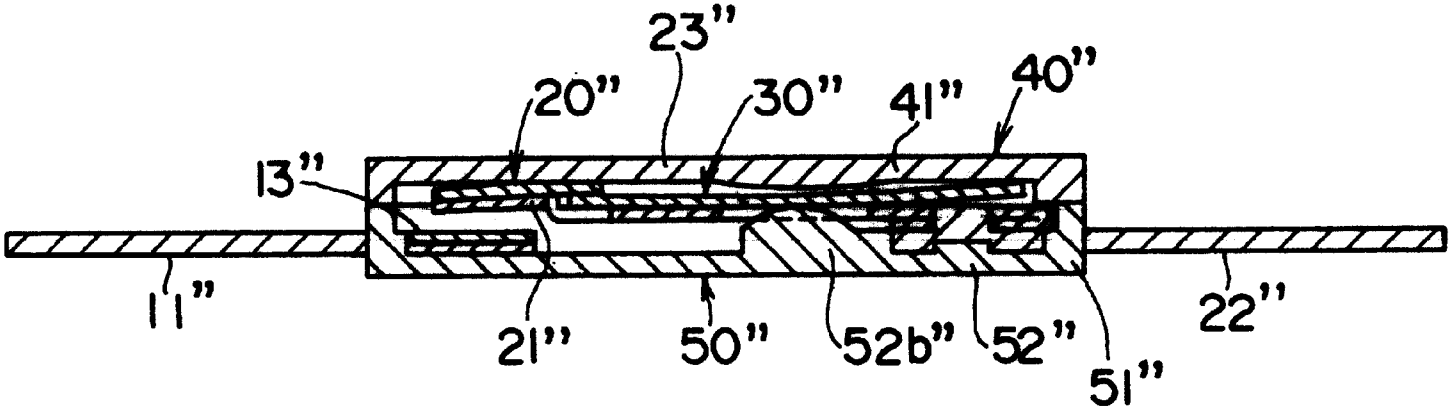
FIG. 14 is a longitudinal sectional view showing a state in which a bimetal element of the thermal protector shown in FIG. 11 performs reversing operation.

As enlargedly showing an essential portion in FIG. 13, a movable plate 20" of the thermal protector in accordance with the fourth embodiment is provided with a raised portion 23" projecting toward the rear of the movable plate 20" in a portion at the rear end and close to a movable contact 21".

The raised portion 23" is formed by forming a cutting line along the contour of the raised portion 23" on the movable plate 20" and then by bending both sides of a front end portion of the movable plate 20" into a step form.

The front end portion of the movable plate 20" is located at an upper position substantially by the thickness of the movable plate 20" as compared with a rear portion of the movable plate 20" by the above-described bending operation. Therefore, an opening (gap) 24" opening toward the rear of the movable plate 20" is formed on the rear end side of the raised portion 23", and a front end portion of a bimetal element 30" is fitted in this opening 24".

The vertical dimension of the opening 24" is slightly larger than the thickness of the bimetal element 30". As shown in FIG. 11, the upper face of the front end portion of the bimetal element 30" substantially coincides with the attachment face of a contact 21" on the movable plate 20".

In the thermal protector in accordance with this embodiment as well, since the front end portion of the bimetal element 30" is fitted in and engaged with the opening 24" formed by the raised portion 23", the shape in the thickness direction can be shortened while a stable switching function is ensured.

Although a cover 40" is formed of a resin in the thermal protector of this embodiment, it is a matter of course that, like the thermal protectors of the above-described embodiments, the cover 40" can also be formed of a metallic sheet.

Figure 10:
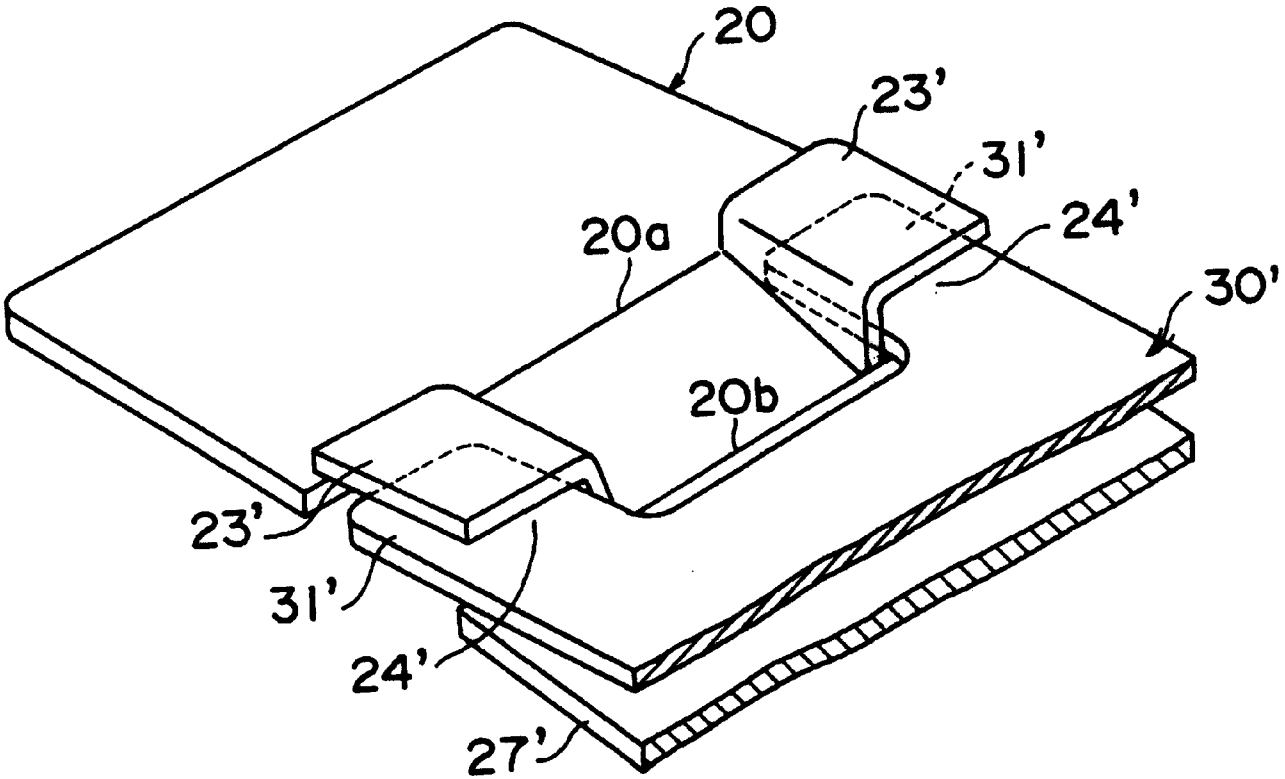
FIG. 10 is a partially enlarged perspective view showing an engagement state of a bimetal element in the thermal protector shown in FIG. 9.

Also, although the raised portion 23" is provided in a central portion of the movable plate 20" in the thermal protector of this embodiment, the raised portion 23" can be provided at both sides of the movable plate 20" as in the embodiment shown in FIG. 10.

Figure 15:
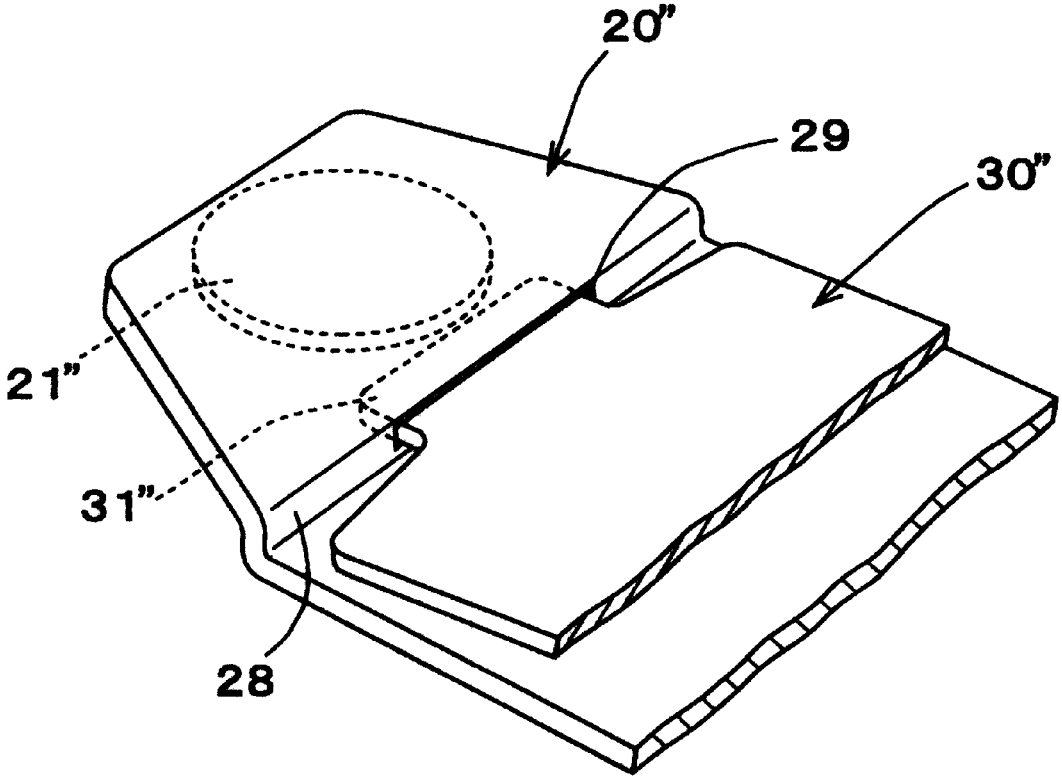
FIG. 15 is a longitudinal sectional view showing a fifth embodiment of a thermal protector in accordance with the present invention.
Figure 16:
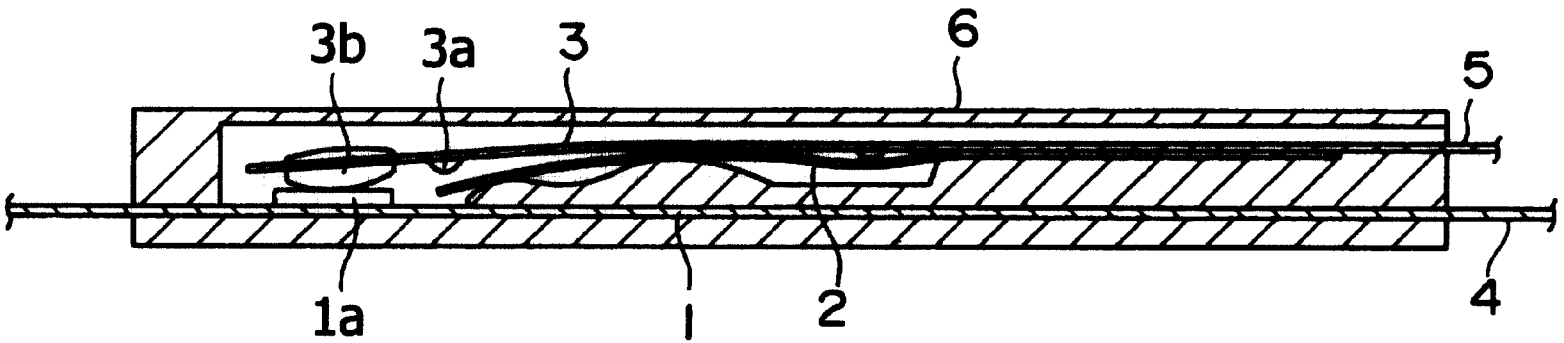
FIG.16 (PRIOR ART)
FIG. 16 is a longitudinal sectional view typically showing a configuration of a conventional thermal protector.

FIG. 15 is a perspective view of a thermal protector in accordance with a fifth embodiment of the present invention. In this thermal protector, a portion close to the rear end of the movable contact 21" of the movable plate 20" is bent into a step form as in the case of the embodiment shown in FIG. 13, but the bending position is set slightly at the rear as compared with the case of the embodiment shown in FIG. 13.

In this thermal protector, a tongue insertion hole 29 is opened in a central portion of a rising face 28 formed by the above-described bending operation, and a tongue 31" formed in the front end portion of the bimetal element 30" is fitted in the tongue insertion hole 29. The tip end of the tongue 31" slightly separates from the rear end of the movable contact 21", and the upper face thereof substantially coincides with the attachment face of the contact 21".

The vertical dimension of the tongue insertion hole 29 is slightly larger than the thickness of the bimetal element 30".

In the thermal protector of this embodiment as well, the shape in the thickness direction can be shortened while a stable switching function is ensured.

The thermal protector of this embodiment has the same construction as that of the thermal protector in accordance with the above-described fourth embodiment with the exception of the engagement construction of the bimetal element 30" with respect to the movable plate 20".

Also, although the tongue 31" is provided in the central portion of the bimetal element 30" in the thermal protector of this embodiment, the tongue 31" can be provided at both sides of the bimetal element 30". It is a matter of course that in this case, the tongue insertion hole 29 is formed at both sides of the rising face 28.

What is claimed is:

1. A thermal protector having a switching mechanism section comprising a fixed conductive plate which has a first terminal for connection to an outside circuit and is provided with a fixed contact on the upper face thereof; an elastic movable plate located over said fixed conductive plate, which has a second terminal for connection to an outside circuit at the rear end thereof and is provided with a movable contact opposed to said fixed contact on the lower face of a front end portion thereof; and a bimetal element located over said movable plate, which operates said movable plate by a warping force when a preset temperature is exceeded, whereby said movable contact is separated from said fixed contact, wherein a raised portion and a lowered portion with the attachment face of said movable contact being the reference are provided at the rear of and close to said movable contact on said movable plate, and a front end portion of said bimetal element is fitted in a gap formed by said raised portion and lowered portion.

2. The thermal protector according to claim 1, wherein said raised portion and lowered portion are formed so that these portions have a substantially cranked shape in cross section, and the lower face of said raised portion is located at a position raised through a distance corresponding to the thickness of said movable plate from the upper face of said movable plate, so that the upper face of the front end portion of said bimetal element fitted in said gap substantially coincides with the contact attachment face of said movable plate.

3. The thermal protector according to claim 1 or 2, wherein a protective cover is provided over said switching mechanism section, and a convex portion for pressing the upper face of a central portion of said bimetal element is formed on the lower face of said protective cover.

4. The thermal protector according to claim 3, wherein the projection height of said convex portion is set so that after an increase in curvature of said bimetal is started by a rise in ambient temperature, a pressing force is released before said ambient temperature rises to the reversing operation temperature of said bimetal element.

5. The thermal protector according to claim 1, wherein a gap formed by said raised portion and lowered portion is provided in a central portion in the width direction of said movable plate.

6. The thermal protector according to claim 1, wherein a gap formed by said raised portion and lowered portion is provided at both sides in the width direction of said movable plate.

7. The thermal protector according to claim 3, wherein said fixed conductive plate is fixed integrally to a resin-made support surrounding the side periphery of said switching mechanism section, and said protective cover is formed of a metallic sheet and is disposed on the upper face of said support.

8. The thermal protector according to claim 7, wherein protrusions are projectingly provided on the upper face of said support, and said protective cover is fixed to said support by fitting holes formed around said cover on said protrusions and then by crushing top portions of said protrusions.

9. The thermal protector according to claim 7, wherein a resin-made frame is integrally formed around said protective cover, and said cover is fixed to said support by welding said frame onto the upper face of said support by ultrasonic welding.

10. The thermal protector according to any one of claims 7 to 9, wherein the outside surface of said fixed conductive plate and/or said protective cover is covered with an electrical insulating film with a small thickness.

11. The thermal protector according to claim 10, wherein said electrical insulating film has a thickness not greater than 50 $\mu$m.

12. A thermal protector having a switching mechanism section comprising a fixed conductive plate which has a first terminal for connection to an outside circuit and is provided with a fixed contact on the upper face thereof; an elastic movable plate located over said fixed conductive plate, which has a second terminal for connection to an outside circuit at the rear end thereof and is provided with a movable contact opposed to said fixed contact on the lower face of a front end portion thereof; and a bimetal element located over said movable plate, which operates said movable plate by a warping force when a preset temperature is exceeded, whereby said movable contact is separated from said fixed contact, wherein a raised portion directed to the rear side from the rear end of a front end portion of said movable plate including said movable contact is formed by bending a portion close to the rear end of said movable contact into a step form so that said front end portion is higher than a portion at the rear of said front end portion, and a front end portion of said bimetal element is fitted in a gap formed by said raised portion.

13. The thermal protector according to claim 12, wherein said raised portion is formed so that the lower face thereof is located at a position raised through a distance corresponding to the thickness of said movable plate from the upper face of said movable plate, so that the upper face of the front end portion of said bimetal element fitted in said gap substantially coincides with the contact attachment face of said movable plate.

14. The thermal protector according to claim 12 or 13, wherein a protective cover is provided over said switching mechanism section, and a convex portion for pressing the upper face of a central portion of said bimetal element is formed on the lower face of said protective cover.

15. The thermal protector according to claim 14, wherein the projection height of said convex portion is set so that after an increase in curvature of said bimetal is started by a rise in ambient temperature, a pressing force is released before said ambient temperature rises to the reversing operation temperature of said bimetal element.

16. The thermal protector according to claim 12, wherein a gap formed by said raised portion is provided in a central portion in the width direction of said movable plate.

17. The thermal protector according to claim 12, wherein a gap formed by said raised portion is provided at both sides in the width direction of said movable plate.

18. A thermal protector having a switching mechanism section comprising a fixed conductive plate which has a first terminal for connection to an outside circuit and is provided with a fixed contact on the upper face thereof; an elastic movable plate located over said fixed conductive plate, which has a second terminal for connection to an outside circuit at the rear end thereof and is provided with a movable contact opposed to said fixed contact on the lower face of a front end portion thereof; and a bimetal element located over said movable plate, which operates said movable plate by a warping force when a preset temperature is exceeded, whereby said movable contact is separated from said fixed contact, wherein a portion close to the rear end of said movable contact is bent into a step form so that a front end portion of said movable plate including said movable contact is higher than a portion at the rear of said front end portion, and a hole is opened in a rising face formed by the bending operation so that a front end portion of said bimetal element is fitted in said hole.

* * * * *